US006094744A

United States Patent [19]

Dibenedetto et al.

[11] Patent Number: 6,094,744

[45] Date of Patent: Aug. 1, 2000

[54] PROTECTIVE COVERING FOR CLOTHING

[76] Inventors: Ramona F. Dibenedetto, 2925 Wigwam Pkwy., Apt. 611, Henderson, Nev. 89014-2873; William P. Dibenedetto, 15 1/2 Water St., Apt. 13, Mystic, Conn. 06355

[21] Appl. No.: 09/195,184

[22] Filed: Nov. 17, 1998

Related U.S. Application Data

[60] Provisional application No. 60/065,890, Nov. 17, 1997.

[51] Int. Cl.[7] ..... A41B 13/10; A41D 27/16

[52] U.S. Cl. ..... 2/50; 2/60

[58] Field of Search ..... 2/46, 50, 60

[56] References Cited

U.S. PATENT DOCUMENTS

| | | |
|---|---|---|
| D. 21,310 | 1/1892 | Kleinert . |
| D. 21,662 | 6/1892 | Rindskopf . |
| 2,544,487 | 3/1951 | Caluthis . |
| 2,674,739 | 4/1954 | Barnett . |
| 2,698,944 | 1/1955 | Younghusband . |
| 2,794,985 | 6/1957 | Brennish . |
| 2,882,529 | 4/1959 | Argo . |
| 3,213,464 | 10/1965 | Lewis . |
| 4,458,364 | 7/1984 | Fenninger et al. . |
| 4,653,119 | 3/1987 | Kaiser . |
| 4,710,980 | 12/1987 | Brison et al. . |
| 4,722,100 | 2/1988 | Greer . |
| 4,980,927 | 1/1991 | Wawiluk et al. . |
| 5,079,777 | 1/1992 | Fowler et al. . |
| 5,608,914 | 3/1997 | Keesler . |

FOREIGN PATENT DOCUMENTS

| | | |
|---|---|---|
| 373 824 | 6/1990 | European Pat. Off. . |
| 207139 | 12/1939 | Switzerland . |

*Primary Examiner*—John J. Calvert
*Assistant Examiner*—Shirra L. Jenkins
*Attorney, Agent, or Firm*—Kenehan, Lambertsen & Stein; John C. Lambertsen

[57] ABSTRACT

A partial covering is provided to be received within and protect a collar of an outer garment, as well as then cover the shoulder and back portions thereof, from stains and like damage during hair treatments at beauty salons. Consisting of a triangular piece of fabric, when the central point is inserted within the collar of the outer garment, the edges defining the opposed triangular sides extend across the shoulder, each terminating at an outer triangular point. The triangular base then extends across the back of the outer garment. A rectangular fabric extension is preferably provided and is centrally attached to the triangular base, extending therefrom to provide further protection to the central back portion of the outer garment.

12 Claims, 2 Drawing Sheets

PROTECTIVE COVERING FOR CLOTHING

CROSS-REFERENCE TO RELATED APPLICATION

This application claims the benefit of U.S. Provisional Application, Serial No. 60/065,890, filed Nov. 17, 1997.

BACKGROUND OF THE INVENTION

1. Field of the Invention

The present invention relates to protective garment, and more particularly, to a removable cape for use in beauty salons and hairdressing establishments to protect the upper portions of a client's outer clothing from damage caused by chemicals and processes applied to the hair.

2. Description of the Prior Art

Many different types and shapes of outer garments have been used by beauty salons in an attempt to protect the outer clothing of customers from damage caused during treatment, particularly hair coloring applications. Traditionally, a client would first remove his or her outer clothing and put on a protective smock or robe. The salon would also normally tuck a towel in about the neck portion of the robe, further protecting the client from any liquids that might drain from hair treatment processes.

In an effort to control costs, such protective smocks and robes are rapidly disappearing from all but the most expensive hair salons. With the clients outer garments protected only by the inserted towels, there is an ever-increasing risk of damage to the client's clothing during hair treatments, particularly hair coloring.

SUMMARY OF THE INVENTION

It is an object of the present invention to assist in the protection of clothing for both men and women while at the barbershop, beauty salon, or like establishments. The invention provides specific protection to the following areas of the clothing: the back and side areas of the collar and/or neck opening of the garment; both shoulder areas; and the upper-back area of the client's outer garment.

In a presently preferred embodiment, the covering is made of a reusable plastic. Such materials are able to protect the clothing from stains and/or odors that may occur from dye, bleach, or other chemical treatments that may drip or run down the back of the neck as the hair is being treated. Its impermeability to such damaging chemicals suggest its use immediately adjacent the outer garment, with a portion of the covering tucked under/inside of the back collar, with the remaining portion extending out to cover the shoulders and back. Further protection is optionally obtained by the placement of a towel about and around the client's neck, with a plastic cape providing the final outer protection.

Some further objects and advantages of the present invention shall become apparent from the ensuing description, and as illustrated in the accompanying drawings.

DETAILED DESCRIPTION OF THE PREFERRED EMBODIMENTS

Figure 1:
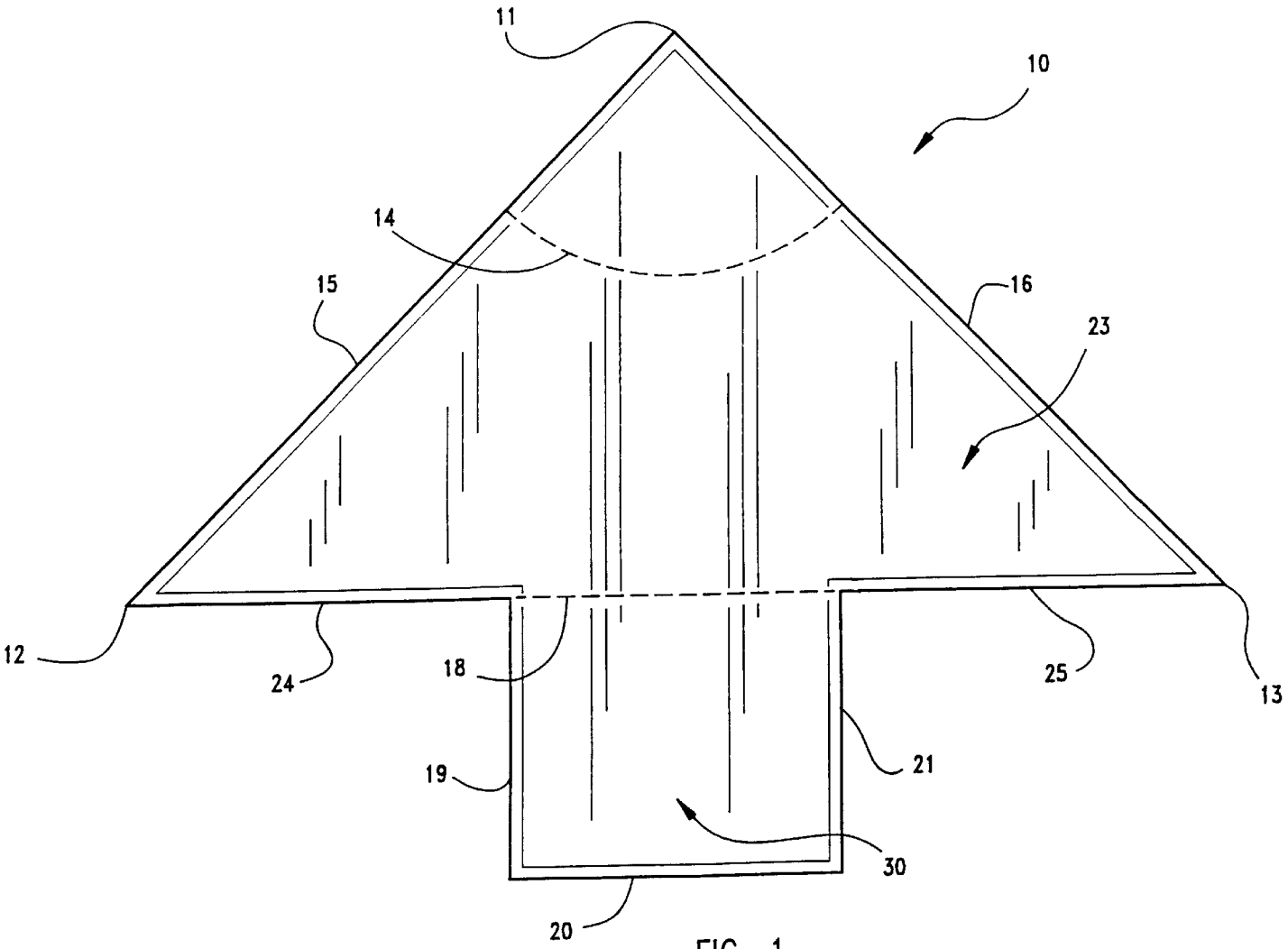
FIG. 1 is a top plan view of a cape, having fold lines depicted therein, in accordance with the present invention.

Reference is now made to the drawings wherein like numerals refer to like parts throughout. In FIG. 1, the illustrated preferred embodiment of the protective covering 10 is shown as a single sheet of durable plastic. The protective covering 10 consists of two linked geometric shapes, an isosceles triangular sheet 23 and an attached rectangular sheet 30.

The triangular sheet 23 has a pair of sides 15, 16, and a base that is comprised of a central base segment fold line 18 and a pair of outer base segments 24, 25. The pair of triangular sides 15, 16 are equal in length, and in a presently preferred embodiment, such length is 23 inches. The base segments, the outer segments 24, 25 and the base segment fold line 18, preferably total 33 inches.

The rectangle sheet 30 contains has a pair of lateral sides 19, 21 and a base side 20. In a presently preferred embodiment, the pair of lateral sides 19, 21 are of equal lengths at 8½ inches, with the base side 20 of equal length to the opposing base segment fold line 18 at 10 inches. The base segment fold line 18 defines a shared border where the triangular sheet 23 and the rectangular sheet 30 are adjacent.

The pair of triangular sides 15, 16 converge to define a point 11. When in use, the point 11 is tucked in between a neck of a person (not shown in FIG. 1) and his or her collar. When the protective covering 10 is so positioned, a pair of outer points 12, 13 defined by the intersection of the triangular sides 15, 16 and the outer base segments 24, 25 are placed upon opposite shoulders of the person. In this manner the triangular sheet 23 is made to extend from the neck to cover both shoulders.

Once the point 11 is tucked under the collar, it creates a partial conical fold 14 (represented by a dotted line in FIG. 1). If the point 11 is properly inserted, the fold 14 will generally rest on and conform to the top of a person's collar, with the point 11 remaining out of sight under the clothing. This positioning will enable the rectangular sheet 30 to rest flatly upon the back of a person.

Figure 2:
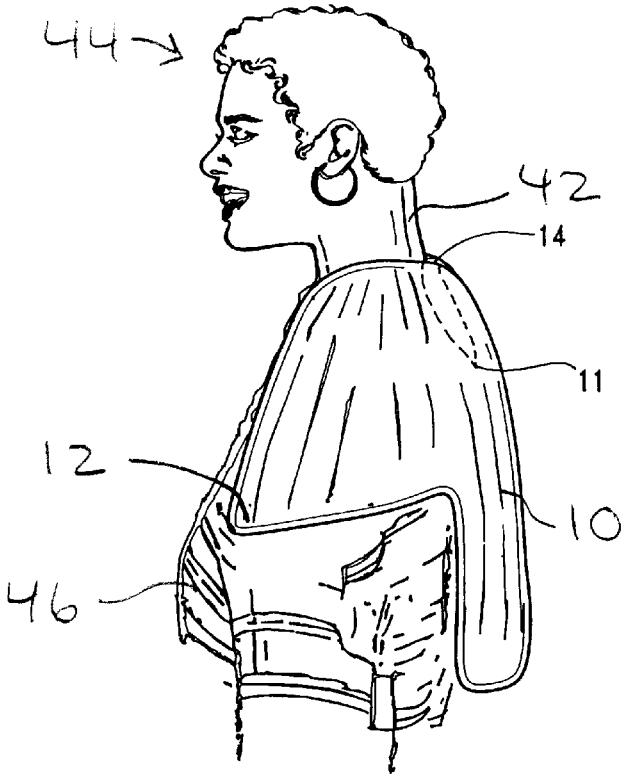
FIG. 2 is a side perspective view, with portions in phantom, showing a cape in place on a client in accordance with the present invention.

Such positioning is illustrated in FIG. 2, with the protective covering 10 placed about a neck 42 of a client 44. As previously described, the point 11 has been tucked under an outer garment 46. As so positioned, the fold 14 is formed about and rests upon the top portion of the collar of the outer garment 46. The outer points 12, 13 (only one shown in FIG. 2) rest upon both shoulders of the client 44. In this manner the triangular sheet 30 extends over and protects both sides of the outer garment 46 from any stains that might be caused when treatment chemicals drip from the hair of the client 44, and down the neck 42.

Figure 3:
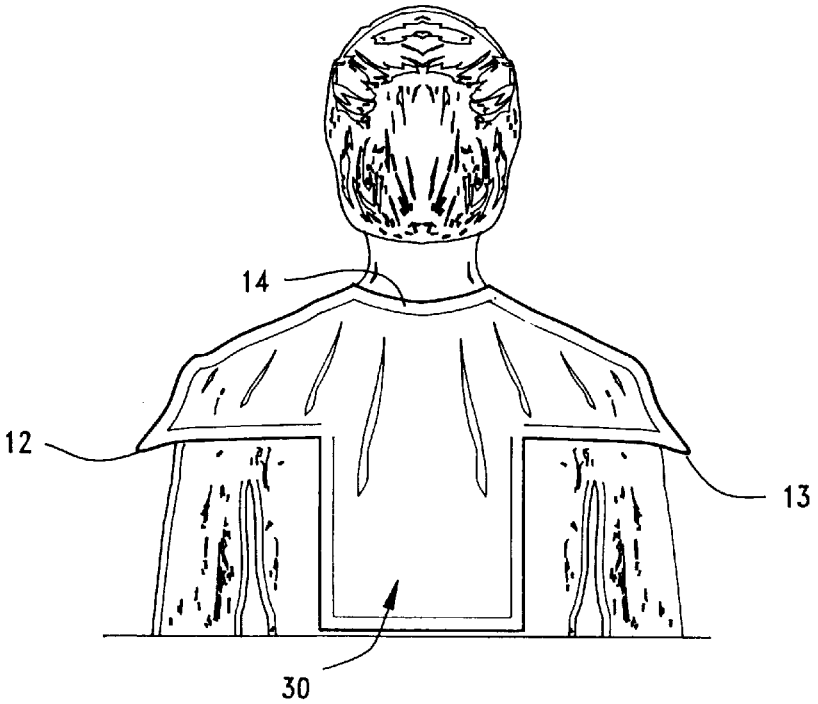
FIG. 3 is a rear perspective view, similar to FIG. 2, showing a cape in place on a client in accordance with the present invention.

The utility of the rectangular sheet 30 is best shown by reference to FIG. 3. With the point tucked behind the collar, and the triangular sheet 23 extending across the shoulders, the rectangular sheet 30 centrally extends down the back of the client 44. In this manner additional protection is provided that area of the back directly below the head. As is shown in FIG. 2, when properly positioned, the protective covering 10 provides a protective layer that extends across the shoulders and drapes down the back of the client 44. In this manner, the client's outer garments are given an added measure of protection from inadvertent spills and drips of the many damaging (to clothing) hair treatment chemicals now in use for hair styling.

Our invention has been disclosed in terms of a preferred embodiment thereof, which provides an improved protective covering for clothing that is of great novelty and utility. Various changes, modifications, and alterations in the teachings of the present invention may be contemplated by those skilled in the art without departing from the intended spirit and scope thereof. It is intended that the present invention encompass such changes and modifications.

We claim:

1. A protective headcover comprising:

an isosceles triangle shaped fabric sheet having a peak and an edge opposite said peak forming a base of the said isosceles triangle shaped fabric sheet; and a rectangular shaped fabric sheet attached to said base and extending therefrom.

2. A protective headcover according to claim 1, wherein a side of said rectangular sheet is attached to said base edge.

3. A protective headcover according to claim 2, wherein said isosceles triangle shaped fabric sheet and said rectangular shaped fabric sheet are fabricated out of a single fabric sheet.

4. A protective headcover according to claim 2, wherein said side of said rectangular sheet is smaller in length than said base edge of said isosceles triangle shaped fabric sheet.

5. A protective headcover according to claim 4, wherein said side of said rectangular sheet is centered on the base of said isosceles triangle shaped fabric sheet.

6. A protective cape for use about a collar of an outer garment to protect such outer garment from damage while chemical hair treatments are performed, comprising:

a fabric sheet having a first edge and a second edge formed therein, said first edge and said second edge intersecting to form a point;

a partial conical fold formed in said fabric sheet upon insertion of said point into said collar of said outer garment, said partial conical fold terminating at each of said first and said second edges with each edge thereafter extending along a separate shoulder of said outer garment; and a third edge formed in said fabric sheet extending from said first edge to said second edge across said outer garment when said point is received within said collar and said first and second edges lie along each of said respective shoulders.

7. A protective cape according to claim 6, and further comprising a supplemental piece of fabric extending from said third edge, providing additional protection for that portion of said outer garment thereby covered.

8. A protective cape according to claim 7, wherein said first edge, said second edge, and said third edge define an isosceles triangle, with said third edge comprising a base of said isosceles triangle and said point located opposite said base.

9. A protective cape according to claim 8, wherein said supplemental piece of fabric comprises a rectangular shaped fabric.

10. A protective cape according to claim 9, wherein said supplemental piece of fabric extends from only a portion of said base.

11. A protective cape according to claim 10, wherein said supplemental piece of fabric is centrally located along said base and opposite from said point.

12. A protective cape according to claim 11, wherein said fabric sheet defining said isosceles triangle and said supplemental piece of fabric comprise a single sheet of fabric.

* * * * *